US009555465B2

(12) United States Patent
Del Fabro

(10) Patent No.: US 9,555,465 B2
(45) Date of Patent: Jan. 31, 2017

(54) DRAWING AND/OR STRAIGHTENING UNIT FOR OBLONG METAL PRODUCTS, SUCH AS BARS, ROUND PIECES OR METAL WIRE

(75) Inventor: Giorgio Del Fabro, Udine (IT)

(73) Assignee: M.E.P. MACCHINE ELETTRONICHE PIEGATRICI SPA, Reana del Rojale (IT)

( * ) Notice: Subject to any disclaimer, the term of this patent is extended or adjusted under 35 U.S.C. 154(b) by 902 days.

(21) Appl. No.: 13/124,394

(22) PCT Filed: Oct. 13, 2009

(86) PCT No.: PCT/EP2009/063339

§ 371 (c)(1),
(2), (4) Date: Apr. 15, 2011

(87) PCT Pub. No.: WO2010/043611

PCT Pub. Date: Apr. 22, 2010

(65) Prior Publication Data

US 2011/0197645 A1 Aug. 18, 2011

(30) Foreign Application Priority Data

Oct. 14, 2008 (IT) ..... UD2008A0216

(51) Int. Cl.
*B21F 23/00* (2006.01)

(52) U.S. Cl.
CPC ..... *B21F 23/002* (2013.01)

(58) Field of Classification Search
CPC ..... B21B 13/04; B21B 1/222; B21B 13/005; B21B 13/06; B21B 31/22; B21B 31/24; B21B 33/00; B21B 3/10; B21B 3/16; B21B 36/05; B21F 1/02; B41B 5/1446;B21D 3/05; B21D 1/02; B21D 1/05; B21D 19/005; B21D 1/00; B21D 3/10; B21D 3/16; B21D 36/05; B21C 47/34

(Continued)

(56) References Cited

U.S. PATENT DOCUMENTS 3,492,850 A * 2/1970 Groppini ..... 72/98
4,022,046 A * 5/1977 Serizawa et al. ..... 72/161

(Continued)

FOREIGN PATENT DOCUMENTS

DE 94 08 8802 U1 9/1994
EP 0 379 028 A1 7/1990

(Continued)

OTHER PUBLICATIONS

International Search Report in Parent PCT No. PCT/EP2009/063339 (3 pages) (Dec. 2009).

(Continued)

*Primary Examiner* — David Bryant
*Assistant Examiner* — Lawrence Averick
(74) *Attorney, Agent, or Firm* — Flaster/Greenberg P.C.

(57) ABSTRACT

A drawing and/or straightening unit for feeding one or more oblong metal products to a machine for working the metal products is included that has a first roller on which at least one metal product being fed is positioned longitudinally. Also included is a second contrasting roller, opposite the first roller. This keeps the metal product correctly positioned during feed. The drawing and/or straightening unit has actuators operationally associated with the second roller to initially move and position the second roller with respect to the first roller and to vary the distance between the rollers. The actuators have actuators for initial movement of the second roller to the first roller, and for selective and controlled movement of the second roller.

4 Claims, 4 Drawing Sheets

(58) Field of Classification Search
USPC ..... 72/31.03, 160, 162–165, 248
See application file for complete search history.

(56) References Cited

U.S. PATENT DOCUMENTS

| | | | | |
|---|---|---|---|---|
| 4,829,801 | A * | 5/1989 | McRaine | 72/164 |
| 5,758,533 | A * | 6/1998 | Quehen | B21D 1/02 72/163 |
| 5,758,534 | A * | 6/1998 | Peyron et al. | 72/165 |
| 5,906,128 | A * | 5/1999 | Del Fabro et al. | 72/161 |
| 7,637,133 | B2 * | 12/2009 | Buta | 72/164 |
| 7,984,634 | B2 * | 7/2011 | Marti et al. | 72/237 |
| 2008/0011036 | A1 * | 1/2008 | Buta | 72/160 |

FOREIGN PATENT DOCUMENTS

| | | | |
|---|---|---|---|
| EP | 0 446 648 | A1 | 9/1991 |
| EP | 0 689 884 | A1 | 1/1996 |
| WO | WO 2007/141273 | | 12/2007 |

OTHER PUBLICATIONS

Written Opinion of the ISA in Parent PCT No. PCT/EP2009/063339 (8 pages) (Dec. 2009).

* cited by examiner

DRAWING AND/OR STRAIGHTENING UNIT FOR OBLONG METAL PRODUCTS, SUCH AS BARS, ROUND PIECES OR METAL WIRE

BACKGROUND OF THE INVENTION

Field of the Invention

The present invention concerns a drawing and/or straightening unit, applicable to feed to a work machine oblong metal products, such as bars, round pieces or metal wire, for example of the type used to make reinforcement for the building trade. In particular, the drawing and/or straightening unit according to the present invention is applied, preferentially but not only, to machines that work simultaneously at least two bars, round pieces or metal wires at a time, feeding them in a substantially uniform, coordinated and simultaneous manner.

Description of Related Art

Bending/shaping machines are known, also called stirrup machines, that are fed with oblong metal products, such as metal wire from a roll, iron round pieces, pre-sheared metal wire or bars, to make reinforcement stirrups for the building trade.

The machines are generally fed with two or more metal products at a time, in order to optimize the productivity of the machine.

Both metal products fed from a roll, and also pre-sheared bars, are generally obtained at the end of the hot rolling cycle and have on the outside a plurality of ribs, so as to improve the conditions under which they grip the concrete, during use.

Since the metal products are made by rolling, and also due to the presence of the ribs, the section of the metal products is not perfectly circular, and they have an oval section characterized by a bigger axis, in correspondence with the ribs, and a smaller axis staggered by about 90° from the bigger axis and smaller by a few millimeters.

It is also known that the work machines, generally at the head, have a drawing and/or straightening unit to feed the metal products to the operating stations of the machine.

The known drawing and/or straightening unit consists of a plurality of rollers opposite with respect to the axis of feed of the metal products, in order to draw them and/or stretch them. Known drawing and/or straightening units normally comprise a driven roller provided with one or more circular throats, in which the metal products to be fed are disposed, and one or more contrasting rollers, opposite the driven roller with respect to the metal products.

The contrasting rollers are not constrained to each other, and each of them exerts a determinate pressure in the direction of the driven roller, in correspondence with a relative circular throat.

The contrasting action is intended to ensure a sufficient friction between the metal product and the driven roller, limiting possible slipping of the metal product in the circular throats.

It is also known that the contrasting rollers can be selectively made to approach the driven roller, depending on the nominal diameter of the metal products being worked.

Moreover, known contrasting rollers are normally cushioned by means of respective elastic elements, for example cup springs, pre-loaded to absorb vibrations, or to compensate, with the pressure exerted, slight variations in the diameter of the metal products as they move.

The approach movement and the pre-loading of the elastic elements in the contrasting rollers are pre-defined and pre-adjusted, before the start of the steps to feed the metal product, depending on the sizes and type of metal product fed.

During the normal feed of known metal products, in particular but not only when fed from a roll, the metal products tend to rotate on themselves, thus varying, during feed, their angular orientation with respect to their longitudinal axis.

This angular variation can lead to a limit condition in which a metal product is orientated with its bigger axis aligned between the driven roller and the respective contrasting roller, whereas another metal product is orientated with its smaller axis aligned between the two rollers, respectively driven roller and contrasting roller.

In order to guarantee drawing even in this limit condition, the adjustment of the approach movement and pre-loading of the elastic elements is carried out empirically in an intermediate condition, presumably valid for both limit conditions of angular orientation of the metal products.

In practice, however, the metal product orientated on the smaller axis is not subjected to sufficient contrast, and slips partly in the relative circular throat, whereas the metal product orientated on the bigger axis is over-contrasted.

The different contrasting action of the contrasting rollers on the individual metal products causes different speeds of feed of the metal products and the relative sliding thereof during feed. Consequently, errors occur in the feed to the operating stations of the machine, and there is a risk of loops forming and the metal products stretching.

In the state of the art, in fact, there is a frequent risk that stirrups may form that have different sizes and that do not correspond to the design data set.

Moreover, the excessive contrast on one of the metal products causes an increase in wear on the circular throats of the driven roller which, with time, lose their efficient guide function, for a correct feed of the metal products.

Purpose of the present invention is to achieve a drawing and/or straightening unit that allows to obviate the disadvantages of the state of the art in a simple and effective way, allowing a simultaneous and coordinated feed of several metal products at a time, substantially whatever the angular orientation of each of them.

The Applicant has devised, tested and embodied the present invention to overcome the shortcomings of the state of the art and to obtain these and other purposes and advantages.

BRIEF SUMMARY OF THE INVENTION

The present invention is set forth and characterized in the independent claim, while the dependent claims describe other characteristics of the invention or variants to the main inventive idea.

In accordance with the above purpose, a drawing and/or straightening unit according to the present invention is applied to feed one or more oblong metal products, such as bars, round pieces or metal wire, to a machine for working said metal products.

The drawing and/or straightening unit according to the present invention comprises at least a first driven roller, provided with at least a circular throat in which a metal product to be fed is able to be positioned longitudinally, and at least a second contrasting roller, opposite the first roller, with respect to the axis of feed of the metal product, so as to maintain the latter efficiently against the first roller, typically inside the circular throat during the feed steps.

The drawing and/or straightening unit also comprises actuator means, operationally associated with the second roller, and able to move the latter in a selected and controlled manner with respect to the first roller.

According to a characteristic feature of the present invention, the actuator means comprise two linear actuators, respectively a first to initially bring the second roller close to the first roller, and a second to perform the selective and controlled movement of the second roller during the feed steps.

In one embodiment of the invention, the axes of movement of the two linear actuators are substantially parallel to each other.

In this way, the distance between the first and the second roller, and hence the contrast applied on the metal product, can be selectively and constantly varied, substantially without any pre-ordained constraint, and substantially continuously during the feed, drawing and/or straightening of the metal product, depending on the real sizes of the metal product and its axial movements and torsions during feed.

With the present invention therefore, by means of the two actuator means, a first so-called positioning actuator and a second continuous and/or instantaneous adjustment actuator, the contrast applied can be varied continuously, extremely precisely and with great sensitivity, with every variation in the angular orientation of the metal product. This guarantees a substantially constant contrasting action and speed of feed, drawing and/or straightening, for the whole duration of the operating steps.

This advantage of the present invention allows to reduce to a minimum both the risk of forming stirrups of different sizes and/or geometric shapes, and also excessive wear on the circular throats.

According to another embodiment of the invention, in which the first roller comprises two or more circular throats for feeding two or more metal products, relative two or more second rollers are provided, independent of each other in their movement toward the first roller.

In this solution, the actuator means can be associated independently with each of the second rollers, so that the latter can be disposed, and hence contrast, the relative metal products independently and in an optimum manner.

This guarantees that each metal product has the same conditions of contrast and feed, irrespective of its angular position and/or size, thus preventing the formation of loops and/or reciprocal slipping of the metal products fed at the same time.

According to a variant, applied in the case of simultaneous drawing of two or more metal products, the actuator means comprise at least a linear actuator for each of the two or more independent second rollers, in order to actuate both an initial approach to the first roller, and also a selective and controlled movement during the feed steps so as to compensate, substantially continuously, the progressive variations in size of the metal product.

According to another variant, again in the case of simultaneous drawing of two or more metal products, the actuator means comprise a first linear actuator, common for all the second rollers, in order to actuate the initial approach to the first roller, and a second linear actuator, for each second roller, to carry out independently the selective and controlled movement of the second rollers.

According to a variant, the actuator means comprise a screw member at least to determine the initial approach of the second roller/rollers to the first roller.

According to a variant, the actuator means comprise at least a drive member.

According to another variant, the actuator means is associated to at least an elastic member able to at least partly cushion the contrasting action of the second rollers on the relative metal product.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

DETAILED DESCRIPTION OF THE INVENTION

Figure 1:
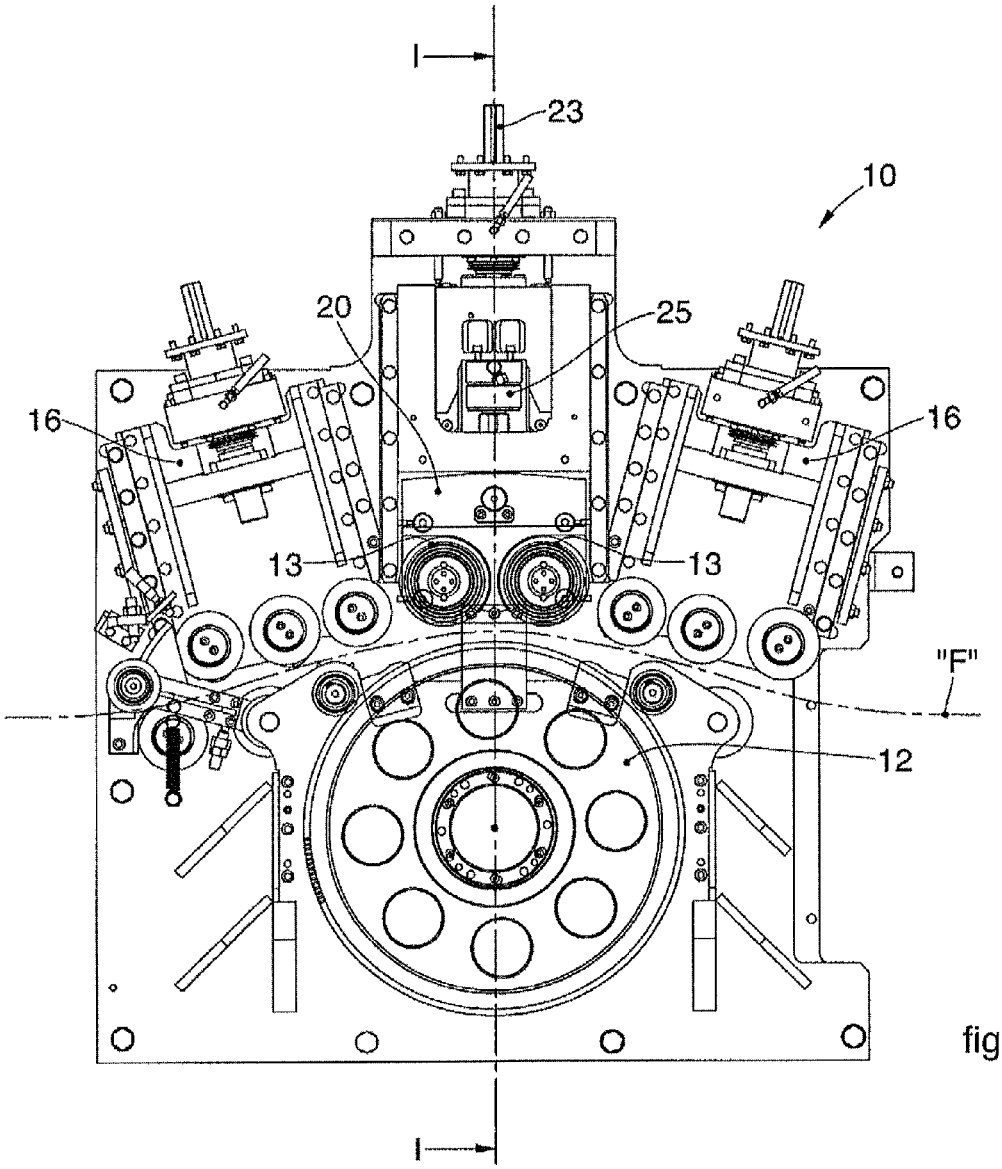
FIG. 1 is a front view of one embodiment of a drawing and/or straightening unit according to the present invention.
Figure 2:
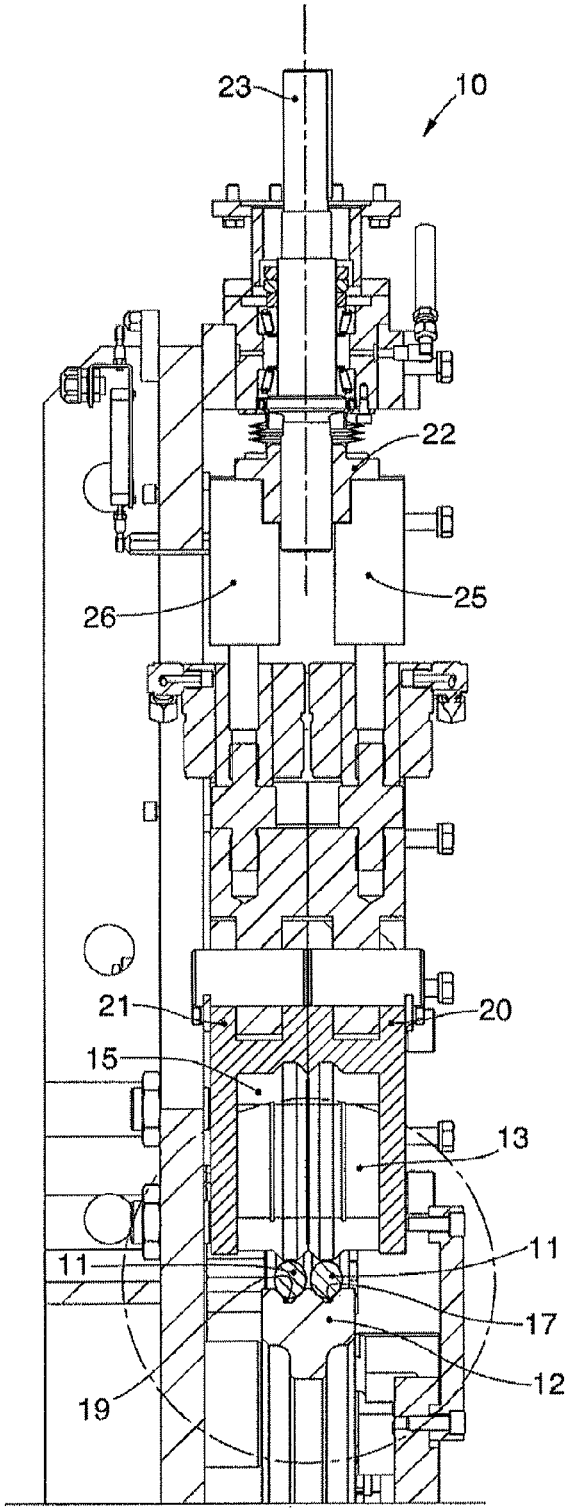
FIG. 2 shows a part section from I to I of FIG. 1, in a first operating condition.
Figure 3:
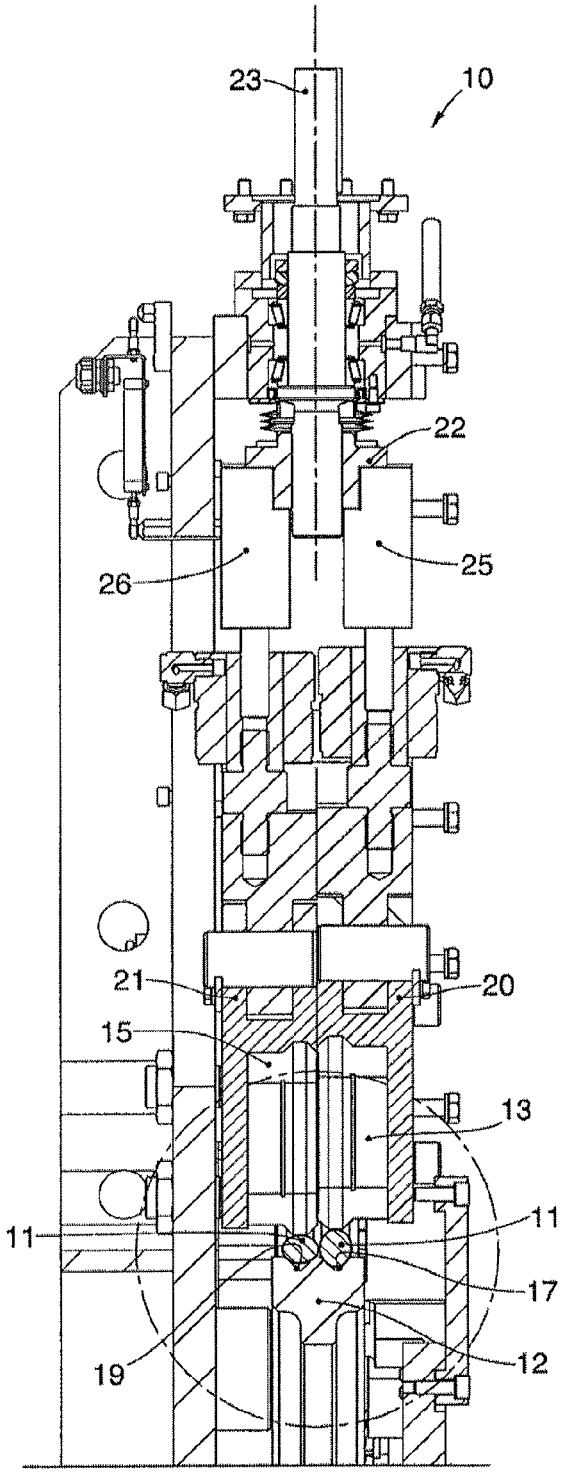
FIG. 3 shows the section from I to I of FIG. 1 in a second operating condition.

With reference to the attached drawings, a drawing and/or straightening unit 10 according to the present invention is applied advantageously, but not exclusively, to a bending/shaping machine, such as a stirrup machine, not shown, that is fed simultaneously with at least two metal wires or round pieces 11.

The drawing and/or straightening unit 10 according to the present invention comprises a first drawing roller 12, driven, two external contrasting rollers 13, two internal contrasting rollers 15 and in this case a plurality of stretching rollers 16, disposed upstream and downstream of the second contrasting rollers 13 and 15 with respect to the direction of feed F of the metal round pieces 11.

In particular, the first drawing roller 12 comprises a single drawing wheel provided on the periphery with two circular throats, respectively external 17 and internal 19, both having a substantially V-shaped cross section and with sizes correlated to the nominal diameter of the metal round pieces 11 to be fed.

The stretching rollers 16 are of a substantially traditional type, and will not be described in detail here.

The second contrasting rollers 13 and 15 are disposed on the opposite side from the first drawing roller 12 with respect to the axis of feed F of the metal round pieces 11.

The second contrasting rollers 13 and 15 are mounted on a mobile support 22, which is able to move together the second contrasting rollers 13 and 15 toward the first drawing roller 12, to reach a predetermined initial position, depending on the sizes of the metal round pieces 11.

The mobile support 22 is selectively movable by means of a screw transmission, or first actuator 23 commanded by a drive member, not shown.

According to a variant, the mobile support 22 is cushioned by elastic members, for example cup springs, to absorb the impacts on the second contrasting rollers 13 and 15 caused by surface imperfections and/or vibrations of the metal round pieces 11.

In this case, the external contrasting rollers 13 are mounted on the mobile support 22 by means of a relative external slider 20, whereas the internal contrasting rollers 15 are mounted on the mobile support 22 by means of a relative internal slider 21.

The external slider 20 and the internal slider 21 are separate from each other and can slide independently one from the other.

In particular, each slider 20 and 21 is operationally associated with a relative second linear actuator 25 and 26, mounted on the mobile support 22. Each second linear actuator 25 and 26 moves the relative slider 20, 21 independently of the other and with respect to the mobile support 22.

The movement imparted by each second linear actuator 25, 26 allows to compensate, substantially continuously and without pre-ordained constraints and with an extremely high level of precision and sensitivity, possible variations in the diameter of the metal round pieces 11 with respect to their nominal size, guaranteeing constant conditions of contrast and feed.

Figure 4:
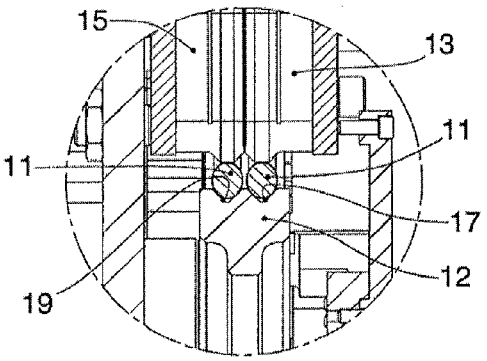
FIG. 4 shows an enlarged detail of FIG. 2.
Figure 5:
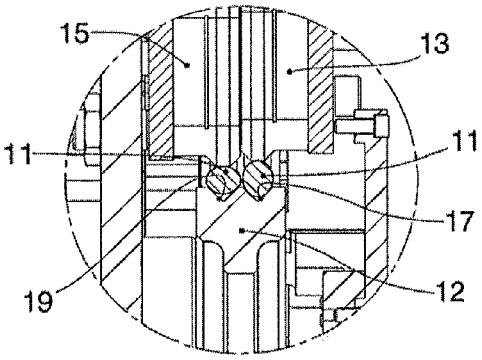
FIG. 5 shows an enlarged detail of FIG. 3.

As can be seen, in particular by comparing FIGS. 4 and 5, when the two metal round pieces 11 are angularly oriented in a substantially analogous manner, the two contrasting rollers 13 and 15 are substantially at the same distance from the drawing roller 12.

On the contrary, when one of the two metal round pieces 11, in this case the one farthest to the left, is angularly oriented in a different way from the other, the difference in diameter, instead of being compensated by a super-pressure, is made up for by the downward movement of the internal contrasting roller 15.

This movement is actuated by the relative second linear actuator 25, until the internal contrasting roller 15 is taken to the normal contrast pressure conditions against the metal round piece 11. The pressure conditions are substantially equivalent to the contrast pressure conditions applied by the external contrasting roller 13.

It is clear, however, that modifications and/or additions of parts may be made to the drawing and/or straightening unit 10 as described heretofore, without departing from the field and scope of the present invention.

For example, it comes within the field of the present invention to provide that instead of the two sliders 20 and 21, a mobile support 22 is provided, conformed so as to provide two mobile parts, independent of each other, and each supporting a relative second contrasting roller 13 or 15.

In this solution, two independent screw transmissions, or first actuators 23 are provided, or other similar actuator member able to effect both the movement of bringing together both the second contrasting rollers 13 and 15, and also the compensating movement of each second contrasting roller 13 or 15, during feed, in order to allow a constant contrast pressure on the metal round pieces 11.

According to a variant, the activation of one or the other of the two second linear actuators 25 and 26 is commanded manually by an operator.

According to another variant, the activation of one or the other of the two second linear actuators 25 and 26 is commanded by sensor members and/or pressure controllers of each second linear actuator 25 and 26, so that it acts always at the same working pressure.

According to another variant, the two second linear actuators 25 and 26 are selectively commanded by optical sensors to control the angular orientation of the metal round pieces 11.

According to another variant, instead of the second linear actuators 25 and 26, motor means are provided, able to move the two second contrasting rollers 13 and 15 independently, so as to constantly guarantee the same working pressure on the relative metal round pieces 11.

According to a variant, the present invention is applied to a traditional drawing unit without stretching rollers 16 and consisting substantially of one or more first drawing rollers 12 and corresponding external 13 and internal 15 contrasting rollers.

According to a variant, each second contrasting roller 13, 15 is mechanically associated with elastic members, to absorb possible vibrations or jumping due to the surface imperfections of the metal round pieces 11.

It also comes within the field of the present invention to provide two screw transmissions, or first actuators 23 able to determine a rough movement of approach of the second contrasting rollers 13 and 15, and two second linear actuators 25 and 26, able to define a precise movement of the second contrasting rollers 13 and 15, so as to guarantee, constantly, that the same contrasting pressure is applied on the metal round pieces.

It is also clear that, although the present invention has been described with reference to specific examples, a person of skill in the art shall certainly be able to achieve many other equivalent forms of drawing and/or straightening unit for oblong metal products, such as bars, round pieces or metal wire, having the characteristics as set forth in the claims and hence all coming within the field of protection defined thereby.

The invention claimed is:

1. A drawing and/or straightening unit for feeding simultaneously two or more oblong metal products to a machine for working said metal products, comprising at least a first driven roller having a drawing wheel provided with two or more circular throats inside each of which are able to be positioned respective metal products, two or more second contrasting rollers, independent from each other in movement and opposite said first roller with respect to an axis of feed of said metal products, each of said contrasting rollers being adapted to keep one relative of said metal products correctly positioned in the relative throat of said first roller during feed, and actuator means operationally associated with said second rollers, and able to move, at least in the initial positioning step, said second rollers with respect to said first roller, in order to vary the distance between said second rollers and said first roller, wherein said actuator means comprise a first linear actuator common for all the second rollers, and two second linear actuators each for a relative second roller, each of said second linear actuators being connected to one respective of said second rollers in order to move the respective second roller linearly independently from another second roller so as to contrast in an independent and optimized manner the relative metal products positioned in the respective throat of the first roller, and wherein said first linear actuator is able to command, for both said second rollers, an initial movement of approach toward the first driven roller, and wherein said second linear actuators are able to carry out the selective and controlled movement of said second contrasting rollers, and hence a contrast is applied to the metal product, substantially continuously during the feed steps, according to the actual sizes of the respective metal product, and wherein the unit further comprises sensor members and/or pressure controllers for commanding the activation of one or the other of said two linear actuators so that they act always at the same pressure.

2. The drawing and/or straightening unit as in claim 1, wherein said first actuator means comprise a screw transmission commanded by a drive member able at least to determine the initial approach of one of said second rollers toward said first roller.

3. The drawing and/or straightening unit as in claim 1, wherein said actuator means comprise at least an elastic member able to at least partly cushion the contrasting action of said second rollers on the relative metal product.

4. The drawing and/or straightening unit as in any claim 1, wherein each of said second roller is mounted on a relative slider mobile independently by means of the action of said actuator means.

* * * * *